US005131838A

United States Patent [19]

Gensler et al.

[11] Patent Number: 5,131,838

[45] Date of Patent: Jul. 21, 1992

[54] STAGED SUPERPOSITION BURNER

[75] Inventors: Wayne C. Gensler, Point Pleasant; John J. Van Eerden, Churchville; Chad F. Gottschlich, Philadelphia, all of Pa.

[73] Assignee: Selas Corporation of America, Dresher, Pa.

[21] Appl. No.: 795,508

[22] Filed: Nov. 21, 1991

[51] Int. Cl.[5] ..... F23C 5/08

[52] U.S. Cl. ..... 431/177; 431/348

[58] Field of Search ..... 431/177, 348

[56] References Cited

U.S. PATENT DOCUMENTS 3,076,498 2/1963 Williams et al. ..... 431/348

5,044,931 9/1991 Van Eerden et al. ..... 431/8

*Primary Examiner*—Carroll B. Dority

*Attorney, Agent, or Firm*—Austin R. Miller

[57] ABSTRACT

A staged, superposition gaseous fuel burner provides substantial reduction of nitrogen oxide content in the combustion gases by providing a transverse turning plate in the burner tip and by staging the delivery rich combustion gases, by introducing premix gaseous fuel in stages spaced with respect to incoming secondary air, thereby exposing the incoming secondary air to spaced stages of the rich mixture.

11 Claims, 1 Drawing Sheet

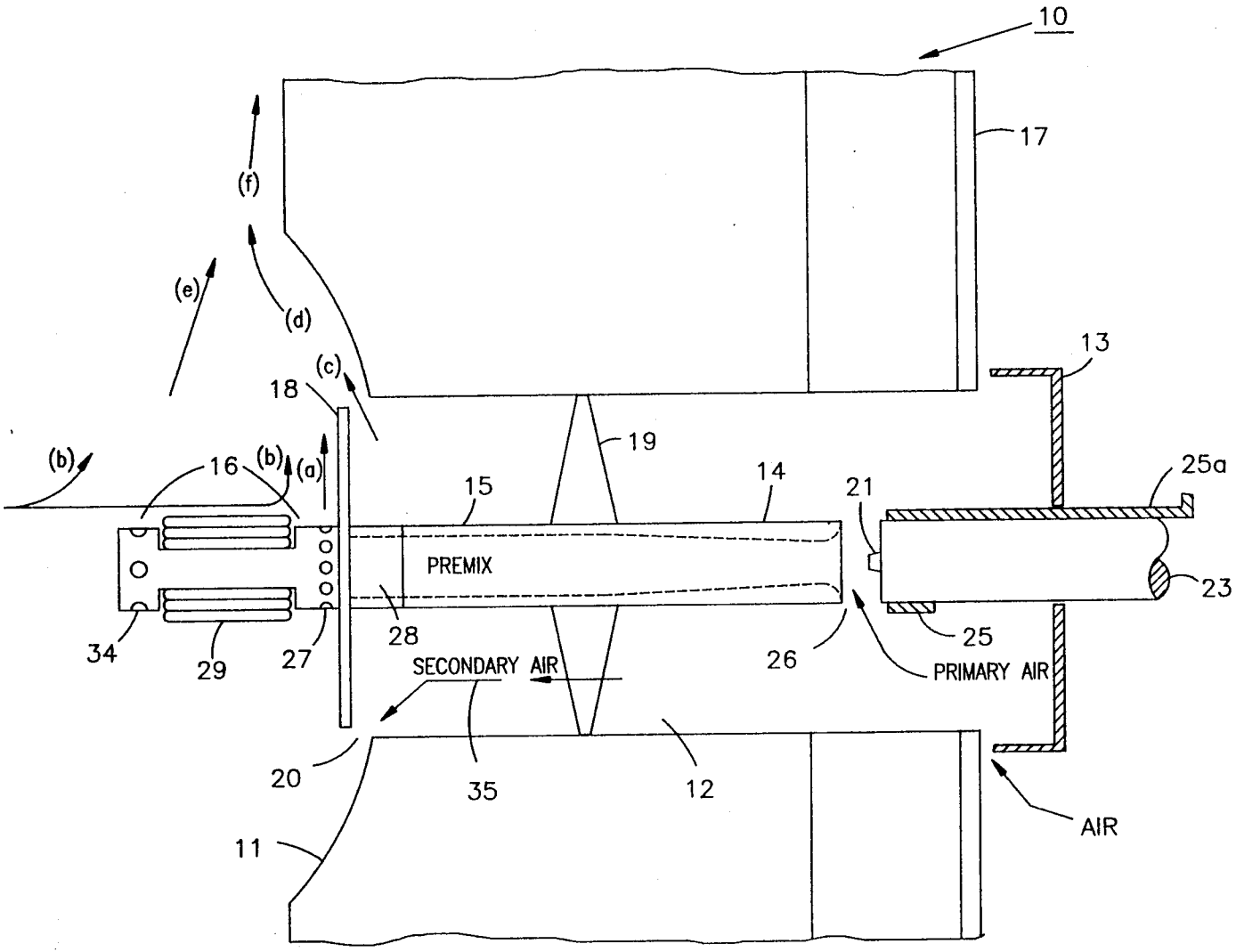
10
17
13
25a
23
AIR
PRIMARY AIR
25
21
26
14
12
19
SECONDARY AIR
35
15
PREMIX
28
(c)
(d)
(f)
(e)
18
(b)
(a)
16
27
20
11
29
34
(b)

STAGED SUPERPOSITION BURNER

BACKGROUND OF THE INVENTION

1. Field of the Invention

This invention relates to a burner, particularly to one for burning a gaseous fuel, and further relates to a method of burning a gaseous fuel in a manner to produce combustion gases having an ultra low content of nitrogen oxide. Hereinafter, nitrogen oxides, which are primarily nitric oxide and nitrogen dioxide, are collectively referred to as "NOx".

Major environmental and other problems have been encountered in the production of flue gases containing high contents of NOx. The NOx tends to react under atmospheric conditions to form environmentally unacceptable conditions, including the widely known phenomena known as urban smog and acid rain. In the United States and elsewhere, environmental legislations and restrictions have been enacted, and more are expected to be enacted in the future, severely limiting the content of NOx in flue gases.

In U.S. Pat. No. 4,874,310, granted Oct. 17, 1989 to Selas Corporation of America, the assignee hereof, a controlled primary air inspiration gas burner was disclosed, in which the introduction of control primary air was controlled in order to provide a substantial reduction of the content of nitrogen oxides in the flue gas. Such a burner includes extra piping for the introduction and control of the primary air, and this sometimes introduces expense and possible complications, especially in furnace installations utilizing a very large number of burners.

In U.S. Pat. No. 5,044,931, granted Sep. 3, 1991, Selas Corporation of America, the assignee hereof, was granted a patent for an apparatus comprising a burner which not only reduces the NOx content in the combustion gases but also radically increases the burner capacity even for the same size burner. In the burner described in this patent, secondary gaseous fuel is being burned in addition to primary gaseous fuel, and the premix introduced through the combustion passageways forms a screen of burned gases which dilute the admixture of secondary gas and secondary air, slowing the secondary fuel reaction rate. However, there are economic limitations as to the cost required in manufacturing and installing burners of the type described in the aforesaid U.S. Pat. No. 5,044,931, and it is an objective of this invention to provide a burner having a simpler and less expensive construction from the manufacturing point of view, one having a small inspirator and one less tip, which does not require expensive machining and which is easy to drill and to assemble.

Other endeavors have been made to reduce the content of NOx in furnace flue gases but many have been found unattractive in view of their requirement of too much operator attention, and in view of the need for extremely attentive control in order to assure that there will be no violation of existing environmental laws. It is very important to be able to obtain a very substantial reduction of NOx content so that even in the event of operator error the environmental law will not be violated and the further operation of the plant and its equipment will not be enjoined by governmental action.

Prior to the discovery forming the basis of the Selas U.S. Pat. No. 5,044,931, it was the general indication in the prior art for premix burners that reduced NOx contents can be obtained by avoiding secondary air, by using substantially entirely primary air, and by firing the burner as close as possible to its maximum firing capacity. The foresaid Selas patent disclosed for the first time that a premix could form a screen of burner gases which dilute the admixture of secondary gas and secondary air, slowing the secondary fuel reaction rate.

OBJECTS OF THE INVENTION

It is accordingly an object of the invention to provide an inexpensive burner wherein exceedingly low NOx contents are obtainable in the exhaust gases. It is a further object of this invention to provide such a burner wherein careful, delicate and precise operator control is unnecessary to achieve the desired low NOx flue gas content.

Another object of this invention is to provide a burner which not only provides radically reduced NOx values for the flue gas but which provides very substantially decreased expenses for manufacture and installation.

Other objects and advantages of this invention, including the simplicity, economy and easy operability of the same, and the ease with which burners may be introduced into new furnaces or retro-fitted into existing furnaces, will become apparent hereinafter, and in the drawing of which:

DRAWING

The drawing is a side sectional view showing a burner embodying features of this invention.

DETAILED DESCRIPTION OF THE INVENTION

It will be appreciated that the following description is intended to refer to the specific form of the invention selected for illustration in the drawing, and is not intended to define or limit the invention, other than in the appended claims.

In utilizing the terms "primary air" and "secondary air" in this specification, it will be understood that the expression "primary air" is intended to be directed to air premixed with the gaseous fuel in the burner, whereas the expression "secondary air" is intended to be applied to air mixed beyond the burner nozzle and not conducted through the body of the burner.

Turning now to the specific form of the invention illustrated in the drawing, the number 10 indicates a furnace wall into which is formed a cup block 11 provided with a hole 12 for burner insertion. The number 13 indicates a secondary air shutter mounted adjacent the furnace casing 17 and movable back and forth with respect to a fuel inlet pipe 23 of the usual type. The fuel pipe 23 is provided with the usual fuel orifice 21 and provided with a primary air shutter 25 which is adjustably movable by a control 25*a*. A primary air inlet 26 is provided adjacent the fuel orifice 21.

The number 14 designates a throat casting provided with a connecting pipe 15 leading to the burner tip 16, separated by a transversely arranged turning plate 18 which is an important and advantageous feature of this invention. The throat casting 14 is held in place by the usual form of centering spider 19 which, of course, is segmented and does not interfere with the longitudinal flow of secondary air. The number 35 designates an annulus for the secondary air, as heretofore discussed.

The number 20 designates a secondary air port conveying secondary air from the secondary air shutter 13 and longitudinally through the annular space outside the throat casting 14 and between the cup block 11 and the rim of the turning plate 18. A plurality of spaced apart premix ports 27 are provided at a location relatively near to the turning plate 18 and will, for convenience, be referred to hereinafter as "near premix ports". These are fed with premix from the premix chamber 28 positioned within the throat casting 14 and feeding premix introduced therefrom.

A plurality of premix ports 34 are provided, relatively far from the turning plate 18, and for that reason referred to for convenience as "far premix ports". The far and near premix ports are spaced longitudinally from each other along the burner tip.

Between the near and far premix ports 27 and 34 is provided insulation 29 which protects the portion of the tip between the near and far premix ports 27 and 34 from overheating as a result of the heat generated in the operation of the burner.

Operation

In operation of the burner in accordance with this invention, the burner is surprisingly very easy to start and very resistant to backfiring. Premix flow (a) from the near premix ports 27 and spent gas flow (b) meet and mix on or adjacent the turning plate 18. The diluted mix then meets the secondary air flow (c) from the secondary air ports 20. The resulting flows mix and burn in cup 11 or in an area close to the turning plate 18 and form a stream (d). Flue gas dilution of the mix from the near premix ports 27 slows combustion and reduces NOx emissions. A further flow of premix (e) emanating from the far premix ports 34 meets and mixes with spent flue gases (b) and the resulting stream then mixes with stream (d) some distance from the tip of the burner and completes combustion. In the case of the cup, which is optional, stream (e) is designed strongly enough to push stream (d) down onto the wall of the furnace to accomplish after-mixing and complete combustion on the furnace wall 10, as indicated by stream (f).

The distance between the near and far premix ports and projection of the burner tip may readily be optimized for creating a flat flame and a very low-NOx burner. The near premix flow (a) creates a zone of burning which tends to flow closely along the burner block and wall, thus reducing pulsing or total flame detachment from the burner, which is an unsafe condition.

The near and far premix ports 27, 34 control the manner in which the fuel is split. An approximately 50/50 area split or fuel split is optimum in many cases. The total (additive) areas of the ports 27, 34, and primary shutter opening coact to control the premix air-to-fuel ratio. The remainder of the air provided to complete combustion is controlled by the cross-sectional area of the secondary air passageway 35, the furnace draft, the setting of the secondary shutter 13, and the area of the secondary air ports 20.

All of this is predetermined in the physical design of the burner which surprisingly eliminates the need for precise and individual control on the part of the operator and requires a minimum of intervention.

It has been found that with this burner the burner NOx is less sensitive to excess air and tramp air than is the case in normal nozzle mix and premix burners.

The burner may be arranged with or without the cup 11. When the burner is used as a cup burner, when the primary air is shut off, the far premix momentum at 34 is decreased and may no longer be able to flatten to flame on the wall. The new flame then becomes a cup type flame which is very stable. This is a design feature which remarkably makes the burner safe to start in a cold furnace.

Normally when gas is mixed with excessive amounts of air the resulting flame emits very high NOx combustion products. Thus, one might expect that the near premix ports 27 would be high NOx emitters. However, this is surprisingly not the case. It is suspected that the turning plate 18 shields the fuel from the air until the fuel has had time to mix with spent gas. The combined stream still has enough momentum to mix thoroughly with the secondary air to promote good combustion.

Likewise, the premix emitted by the far premix ports 34 mixes with spent gas before meeting enough air to begin rapid combustion. The far premix ports 34 if used alone would constitute a very low NOx burner; however the flame produced would tend to pulse with intensity and to be destructive to the furnace refractory. The near premix ports 27 have the unique coacting effect of stabilizing the far premix ports 37 and the resulting combination creates a highly advantageous low NOx burner.

In the case where the supply is all primary air (no secondary air), the exit velocity and the port shape must be designed to promote flame detachment from the burner. This then allows the mixture to mix with spent gas before ignition.

Method of Operation

In accordance with the start-up procedure for the burner in accordance with this invention, for first ignition in a cold furnace the primary shutter 25 is set to its start-up position and closed, causing raw gas to flow out of near premix ports 27 and out of far premix ports 34. The shutter 13 is opened providing primary air at 26 and secondary air at 20. When the furnace reaches operating temperature, the primary shutter 25 is moved to its open position and the secondary shutter 13 is adjusted to existing excess air requirements depending upon the local draft. A rich premix issues from near premix ports 27 at high velocity and secondary air flows out the secondary air port 20. The two resulting streams meet, mix and burn in the cup or on the furnace wall near the burner tip. A rich premix flow emanates from the far premix ports 34 and flows generally as indicated by the arrows (e) and (f) from (c) and (d), and begins to burn at the wall, meeting the lean mixture and completing combustion.

It is an advantage according to this invention that all air-to-fuel ratios may be used in the premix and still obtain combustion products having low NOx. The air-to-fuel ratios may vary from 100% primary air to 100% gaseous fuel. Of course, design variations will take place throughout such a wide range according to the air-to-fuel ratio with a larger body with larger ports provided in the case of 100% primary air, this is ideal for use in a forced air burner. The use of a single air and fuel source requires high velocities obtainable only with forced air.

In the case of utilization of no primary air, the burner has the advantage of being simplest and least expensive to build but it will require small fuel ports which tend to plug up.

For those burners having intermediate ratios of air-to-fuel such as 1:1 to 1:2 air-to-fuel, ports can be provided which are much larger to prevent clogging. Further, the premix air helps to cool the metal of the tip. The low air-to-fuel ratio gives good backfire resistance also. With such air-to-fuel ratios, the start-up in a cold furnace is done by closing the primary air shutter to provide a reduced velocity and a stable, involuting flame.

The use of 1:1 to 1:2 air-to-fuel ratios works well with refinery fuels and other feeds having wide swings in Wobbe index. These wide swings can be tolerated without requiring a change in the air shutters for controlling the furnace excess air.

This application is related to our co-pending application Ser. No. 795,680 directed to an inspirated staged burner which achieves very low NOx values in a different way.

Although this invention has been described in relation to a particular burner, as described and shown, it will be appreciated that a wide variety of changes may be made without departing from the spirit and scope of this invention. Accordingly, certain features shown in the drawing may be modified or perhaps even removed in specific cases, such as the insulation 29, the spider 19 and other primarily mechanical features, all without departing from the spirit and scope of the invention. Accordingly, the scope of the invention is not intended to be limited by the foregoing description, but only as set forth in the specific claims.

We claim:

1. A gaseous fuel burner comprising a burner body having a burner tip installed in a wall of a furnace or the like for combustion of gaseous fuel therein, comprising:

a primary supply means for introducing a mixture of primary gaseous fuel and primary air as a premix forwardly along said burner body;

said burner having a tip for discharging said premix in a direction extending along an inner surface of said furnace wall, secondary air supply means comprising a secondary air passage extending along said burner body and having a secondary air outlet opening which is at a location spaced from said premix discharge of said tip, said burner tip having a transversely arranged separator forming a guide shaped to cause outward flow of said secondary air for ultimate blending with said premix discharge; and said burner tip comprising at least two spaced-apart premix discharges, one forming a near premix discharge area which is closer to the secondary air point of introduction and the other forming a far premix discharge area which is farther away from the secondary air point of introduction, whereby said spaced-apart premix discharges provide for staged mixing of said premix with said secondary air.

2. The gaseous fuel burner defined in claim 1 wherein said near premix discharge area which is closer to said transversely arranged separator has a larger number of discharge ports than said far premix discharge.

3. The gaseous fuel burner defined in claim 1 having insulation applied to the burner tip in between the near premix discharge ports and the far premix discharge ports.

4. The gaseous fuel burner defined in claim 1 wherein the far premix discharge ports and the near premix discharge ports have sufficient distance between them to cause staged combustion to occur, thereby providing for minimum NOx emission.

5. The gaseous fuel burner defined in claim 1 wherein said burner tip is movably mounted to provide for ease of removal of the burner for maintenance.

6. The gaseous fuel burner defined in claim 1 including means for varying the burner air-to-fuel ratio throughout the range from all primary air to all secondary air.

7. The gaseous fuel burner defined in claim 1 further comprising an air supply which may be selected from the group consisting of forced primary and secondary, forced primary and draft secondary, forced preheated secondary and inspirated primary, and inspirated primary and draft secondary.

8. The gaseous fuel burner defined in claim 1 installed in a wall, floor or roof of a furnace.

9. The gaseous fuel burner defined in claim 1 installed in a furnace member selected from the group consisting of a cup and a flat block.

10. The gaseous fuel burner defined in claim 1 wherein the sizes and numbers of said premix discharge and said secondary air openings are controlled to produce an air-to-fuel ratio of about 1:1 to 1:2.

11. The gaseous fuel burner defined in claim 1 wherein each of said spaced-apart premix discharges has a plurality of ports balanced in number and area to provide substantially equal amounts of premix delivery as between said near ports and far ports.

* * * * *